United States Patent [19]

Hügin

[11] 4,171,473

[45] Oct. 16, 1979

[54] DEVICE FOR TERMINATING ROTARY MOVEMENT OF A DRIVEN SHAFT

[75] Inventor: Hans Hügin, Bad Bellingen, Fed. Rep. of Germany

[73] Assignee: Bautex Adolf Stover KG, Langen, Fed. Rep. of Germany

[21] Appl. No.: 878,120

[22] Filed: Feb. 15, 1978

[30] Foreign Application Priority Data

Mar. 30, 1977 [DE] Fed. Rep. of Germany ..... 2714021

[51] Int. Cl.[2] ..... H01H 19/18

[52] U.S. Cl. ..... 200/47; 74/750 R

[58] Field of Search ..... 200/30 R, 47, 153 LB, 200/38 B, 38 C; 74/750 R, 801

[56] References Cited

U.S. PATENT DOCUMENTS

| | | | |
|---|---|---|---|
| 1,270,255 | 6/1918 | Barker | 74/750 R |
| 2,417,176 | 3/1947 | Ratie | 200/47 |
| 2,519,907 | 8/1950 | Hodgson | 200/47 |
| 2,792,468 | 5/1957 | Kozikowski | 200/153 LB |
| 2,903,528 | 9/1959 | Kuhn | 200/30 R |
| 3,327,194 | 6/1967 | Trapp | 200/47 |
| 3,821,502 | 6/1974 | Toeckel | 200/38 B |

*Primary Examiner*—Richard E. Aegerter
*Assistant Examiner*—John W. Shepperd
*Attorney, Agent, or Firm*—Irvin A. Lavine

[57] ABSTRACT

A device for terminating the rotary movement of a driven shaft following an adjustable predetermined number of revolutions, with one or more switch disks arranged coaxially adjacent and provided with notches of their outer circumference, said disks being driveable by the shaft, with a plurality of switch disks with different rotational speeds, and with a switch arm resting on the outer circumference of the switch disk(s), said arm dropping into the notch and/or (in the case of a plurality of switch disks) notches, when the latter correspond in their angular position, thus shutting off the drive to the shaft.

7 Claims, 2 Drawing Figures

DEVICE FOR TERMINATING ROTARY MOVEMENT OF A DRIVEN SHAFT

BACKGROUND OF THE INVENTION

This invention relates to a device for terminating the rotary movement of a driven shaft after an adjustable predetermined number of revolutions.

In many areas of technology, devices are required which terminate the rotary movement of a driven shaft following an adjustable predetermined number of revolutions. In most applications, an electric motor drive is involved, the current supplying said motor being interrupted by an electrical signal, produced after a specified number of revolutions of the motor shaft. Preferred areas of application are electrical appliances and positioning drives in designing installations.

The device according to the invention is indeed suitable for all of the applications cited hereinabove, but has been specially developed for electric motor drives for venetian blinds, and will therefore be discussed with reference to this sample application.

In all electric-motor venetian blinds, it is necessary to provide a limit switch internal to the device, which terminates the flow of current after the shaft of the drive motor has made a specified number of revolutions, so that the motor stops. Without such a limit switch internal to the device, there is danger of destruction of the installation by careless actuation of the control device. In the case of horizontal venetian blinds, the supply of current for the selected direction of rotation of the electric-motor drive is interrupted by the limit switch after the slats have been raised by means of the winding shaft. When the venetian blind is lowered, the current is interrupted in similar fashion after the lowest limiting position is reached. In the case of venetian blinds with vertically mounted slats, the drive shaft and/or electric motor must be shut off after the slats of the blind have been collected together at one side, and also after the slats have been spread out laterally, in order to avoid destruction of the installation.

If rotary movement is used to produce a linear displacement, as in the case of venetial blind drives, this type of limit switching can be accomplished in known fashion by limit or stop switches, disposed at the ends of the displacement path. The disadvantage of this known solution consists in the fact that additional wires and switches must be installed.

It is also known to use a counter drive to shut off the rotary movement after a predetermined number of revolutions, said counter drive actuating a microswitch for example. A counter drive of this kind is relatively complex in design and poses difficulties as far as adjusting the desired number of revolutions is concerned.

Finally, devices of the type described hereinabove are known wherein the switch disks, disposed coaxially adjacent to one another and provided with notches in their outer circumference, are driven at slightly different rotational speeds. A switch arm, extending axially above both switch disks, drops into the notches, when the angular position of the latter coincides in the vicinity of the switch arm. As it drops, the switch arm interrupts the supply of current to the drive motor, the arm actuating a microswitch for example. The adjustment of the end positions is accomplished by turning the switch disks on their shaft and then locking them in place using grub screws or notches.

When grub screws are used to lock the disks in position, there is the danger that these screws will be loosened by the vibrations produced by the motor and will therefore not hold the set end positions. Furthermore, the grub screws can deform the shaft if they are tightened excessively, since the shaft, at least in the case of one switch disk, must be made in the form of a hollow shaft. Even when the adjustment disk are held in place by notches, loosening may occur resulting in rotation of the switch disks from their set positions.

Finally, it is disadvantageous that a tool is required to adjust the switch disks.

SUMMARY OF THE INVENTION

The goal of the invention is to provide a compact, easily adjustable device for terminating rotary movement, wherein spontaneous loosening of the switch disks from their set positions is eliminated.

The goal is achieved according to the invention in a device of the type described hereinabove, by virtue of the fact that a central gear, axially elongated and driveable by the shaft, is provided by the fact that the central gear is surrounded by bushing-shaped planet carriers, said carriers being axially adjacent and mounted nonrotatably, the number of said planet carriers corresponding to the number of switch disks, by the fact that at least one planet gear is mounted on each planet carrier, said gear meshing with the central gear, by the fact that the switch disks are mounted rotatably on the outer circumference of the planet carriers, and are provided with internal teeth of different numbers, said teeth meshing with the planet gears of the corresponding planet carrier.

The device according to the invention is extremely compact in design and can be installed as a drive block between two plates, occupying a minimum amount of space. It is also possible thereby to mount the entire shutoff device as a separate component in the factory, so that it is extremely simple to set the shutoff device to any setting.

Furthermore, the individual parts of the device can be made completely of plastic, thus allowing cost-favorable mass production. The use of plastic is also favored in particular by the fact that all of the teeth in the device are always in mesh, so that wear is extremely low.

Finally, spontaneous loosening and shifting of the adjustments of the switch disks is eliminated. The shutoff device also remains reliable over a long period of time, so that no checking or maintenance is necessary.

In an advantageous embodiment of the invention, the planet carriers are provided with axially projecting pins, which fit into corresponding recesses in the adjacent planet carrier and/or one of the two drive plates accepting the device for nonrotational connection. This embodiment considerably facilitates the manufacture and assembly of the device. No screw connections are required to assemble the planet carriers and hence the drive block, said process being especially costly as far as manufacture and assembly time is concerned.

This embodiment is especially simple if the planet gears are mounted on axially projecting bearing pins of the planet carriers, the forward ends of which mesh with the recesses of an adjacent planet carrier and/or drive plate for non-rotational connection.

In an especially advantageous embodiment, the central gear is mounted axially displaceably and connected permanently with a coaxially disposed gear, said gear meshing with a drive gear of the driven shaft when the central gear is at one end position of the axial displacement path, and not meshing with this drive gear at the other end position of the displacement path.

Advantageously, in this embodiment the central gear has a shaft stub that extends beyond the drive plate, having an adjustment knob mounted on the shaft stub, and being provided with a locking element, said element being movable into a circumferential notch on the shaft stub and/or the adjustment knob to prevent axial displacement of the central gear, corresponding to the end position of the displacement path corresponding to the meshing with the drive gear.

This embodiment allows adjustment of the number of revolutions and/or of the end positions, without a tool being required. Adjustment can be carried out extremely simply even by untrained workers. It is merely necessary to displace the central gear axially with the aid of the adjustment knob. This interrupts the rotary drive connection between the driven shaft and the central gear. The switch disks can then be turned freely by means of the adjustment knob until they assume a position in which the switch arm can drop into the notches. The driven shaft is then rotated until the desired end position of the device driven by this shaft, for example a venetian blind, is reached. Then the central gear is displaced once again with the aid of the adjustment knob until the gear connected to the central gear meshes with the drive gear and the rotary drive connection is restored. The shutoff point of the device is thus set exactly at the desired end position. It is now merely necessary to prevent the central gear from making any undesirable axial displacements by virtue of the locking element.

If it is desired to shut off the motor in two end positions of the rotary movement of the driven shaft, as is usually the case in practical applications, two central gears with corresponding planet carriers are advantageously provided, together with planet gears, switch disks, and switch arms, whereby both central gears mesh with a common drive gear on the driven shaft by means of firmly connected gears. In this embodiment, the entire device can be mounted as a compact unit between two plates.

In general, it is advantageous to design the device according to the invention with two or more switch disks. The different numbers of teeth on the insides of these switch disks determine the number of revolutions of the motor shaft after which the notches of all switch disks reach the same angular position, so that the switch arm can drop into the notches and shut off the motor after the shaft has made only a few revolutions, the device according to the invention can be designed easily with only one switch disk.

On the other hand, in order to shut off the motor after the motor shaft has made a very large numer of revolutions, the difference in the number of gear teeth between the individual switch disks in the device according to the invention can be reduced to one tooth each, whereby the number of switch disks can be increased to as many as six disks. In order not to increase the construction costs of the device considerably thereby, only a single planet gear can be used for each switch disk. In this manner, the accuracy of the output signal relative to the motor shaft is reduced, but on the other hand there is a considerable increase in the number of revolutions of the motor shaft until shutoff.

The simple adjustability, inexpensive manufacture from plastic, freedom from maintenance and malfunctions, and the compact design make the device according to the invention especially suitable for use with venetian blinds.

For this application, it is also advantageous to provide a considerable range of variation in the adjustable numbers of revolutions of appropriate selection of the ratio of the number of teeth on the inner surfaces of the individual switch disks, without thereby influencing the accurace of determination of the shutoff point.

Other objects and advantages of the present invention will be apparent from the following specification, claims and drawings.

BRIEF DESCRIPTION OF THE DRAWINGS

In the following, the invention is described with reference to an embodiment shown in the attached drawing.

DESCRIPTION OF THE PREFERRED EMBODIMENT

Figure 1:
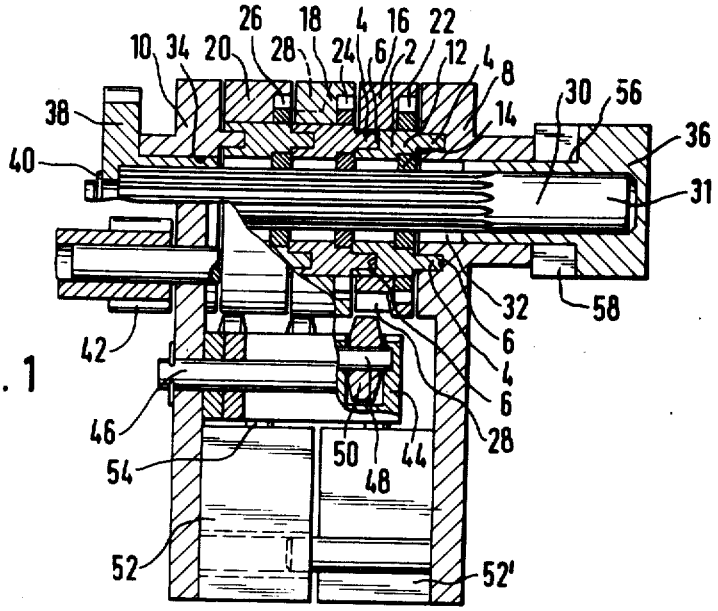
FIG. 1 shows a cutaway lengthwise section through a device according to the invention.
Figure 2:
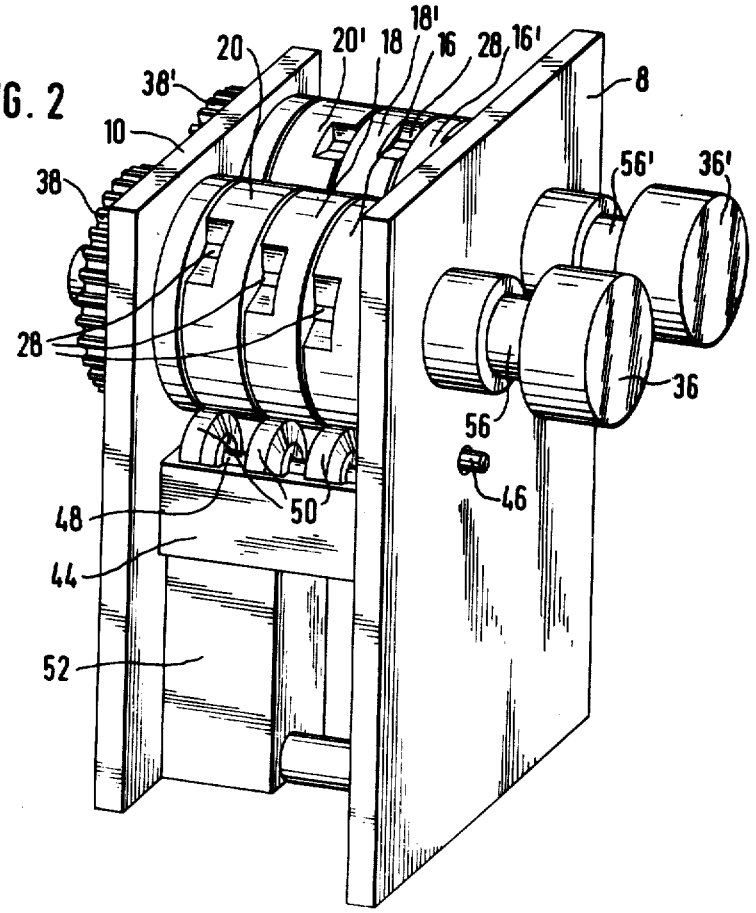
FIG. 2 is a perspective view of this device.

The shutoff device shown in the drawing is provided with three identical bushing-shaped planet carriers 2, each of which has at one end, two diametrically disposed axially projecting pins 4 or segments and at the opposite end, correspondingly disposed holes or recesses 6. With the aid of these pins 4 and recesses 6, planet carriers 2 are assembled coaxially adjacent to one another, so that they are connected nonrotatably with one another. The assembled planet carriers 2 are disposed between two drive plates 8 and 10, whereby plate 8 is exposed for actuation when installed in the device, while plate 10 in the installed state faces the drive motor to be shut off. The planet carrier 2, i.e., the one of the three which is at the right in the drawing, has its projecting pin 4 inserted in corresponding recesses 6 in plate 8, whereby the entire arrangement of three planet carriers 2 is held nonrotatably between plates 8 and 10.

Each planet carrier 2 is provided with one or more axially projecting bearing pins 12 at one end, upon which pins planet gears 14 are rotatably mounted. In the embodiment shown, two diametrically arranged bearing pins 12 are provided, whereby the forward ends of these bearing pins 12 are designed as pins 4, which are inserted in corresponding recesses 6 of adjacent planet carrier 2 and/or drive plate 8.

One switch plate 16, 18, and/or 20 is mounted on the outer circumference of planet carrier 2 in a rotatable fashion. The switch plates 16, 18, 20 are provided with hollows on the axial ends corresponding to bearing pins 12 of planet carriers 2, said hollows being provided with inner teeth 22, 24, and 26. These inner teeth 22, 24, 26 mesh with planet gears 14. While the three planet gears 14 are similar, internal teeth 22, 24, 26 of switch disks 16, 18, 20 have different numbers of teeth for equal circle segment diameters. In the example shown, switch disk 16 has 30 teeth, switch disk 18 has 32 teeth, and switch disk 20 has 34 teeth. An elongated central gear 30 is disposed coaxially in planet carriers 2, said gear being mounted rotatably and axially displaceably in a bore 32 of outer drive plate 8 and in a bore 34 of drive plate 10 on the drive side. The teeth of central gear 30 extend over the entire length of the three planet carriers 2 and mesh with planet gears 14.

Central gear 30 has a shaft stub 31 which extends beyond outer drive plate 8. A rotary and adjustable knob 36, preferably injection molded, is mounted on shaft stub 31. A gear 38 is mounted nonrotatably on the other axial end of central gear 30, and is prevented from axial displacement on central gear 30 by means of a locking ring 40.

Gear 38 meshes with a drive gear 42, said gear 42 being driven by the series-connected device, for example the electric drive motor, of a venetian blind.

The axial width and the axial position of gear 38 and of drive gear 42 are determined relative to the axial displacement path of central gear 30 in such manner that gear 38 meshes with drive gear 42 in the end position along the displacement path of central gear 30, shown in FIG. 1, while in the left-hand end position on the displacement path of central gear 30, not shown in FIG. 1, gear 38 is axially out of mesh with drive gear 42. In the right-hand end position along the displacement path of central gear 30, shown in FIG. 1, wherein gear 38 is in mesh with drive gear 42, a circumferential recess 56 is formed between the inner end of adjustment knob 36 and the axially outer end of drive plate 8 and/or a boss on this plate 8, into which recess a forked locking element 58, fitting around shaft stub 31, can be inserted radially, in order to prevent central gear 30 from being displaced axially.

If central gear 30 is driven by gear 38 by means of drive gear 42, switch disks 16, 18, 20 are driven at different angular velocities, because of the different numbers of teeth on inner surfaces 22, 24, and 26, via planet gears 114.

In the example given, with 30, 32, and 34 teeth, switch disk 16 will be driven at an angular velocity approximately 5% higher (and switch disk 20 at an angular velocity approximately 5% lower) than switch disk 18.

Switch disks 16, 18 and 20 are each provided with one notch 28 on their outer circumferences. Between the two drive plates 8 and 10, a switch arm 44 is swivelly mounted on a shaft 46 beneath the switch disk. Switch arm 44 is provided with a switch roller axis 48, on which three switch rollers 50 are mounted in such fashion that they roll on the circumference of switch disks 16, 18 and 20.

A microswitch 52 is disposed beneath switch arm 44, said microswitch pressing switch arm 44 and hence switch roller 50 against the outer circumference of switch disks 16, 18, and 20 with its spring-loaded switch pin 54.

When, due to the different angular velocities of the three switch disks 16, 18, and 20, the angular position of the three notches 28 of these switch disks coincide in the angle range of switch roller 50, switch arm 44 with the three switch rollers 50 can drop into the notches 28, actuating microswitch 52.

Actuation of microswitch 52 turns off the drive in one rotational direction. For example, this determines one end position of a venetian blind.

For the second rotational direction of the drive motor, an identical shutoff can be provided, determining for example the other end position of a venetian blind. For this second shutoff, an identically constructed arrangement is provided consisting of central gear 30' with gear 38' and adjustment knob 36' as well as planet carriers 2', planet gears 14', switch disks 16', 18', 20', switch arm 44' and microswitch 52' mounted thereon. All of these are disposed between the same drive plates 8 and 10. Both gears 38 and 38' mesh with the same drive gear 42.

To adjust the shutoff point, each of central gears 30 and/or 30' is displaced axially by means of adjustment knobs 36 and/or 36' into the left-hand end position shown in FIG. 1, so that the rotary drive connection between gears 38 and/or 38' and drive gear 42 is interrupted. Switch disks 16, 18, 20 and/or 16', 18', 20' can now be rotated independently of the drive by turning adjustment knobs 36 and/or 36', until the switch position is reached in which switch arm 44 and/or 44' drops with its switch roller 50 and/or 50' into notches 28 and/or 28'.

In practical applications, the shutoff device is preadjusted at the factory in such manner that after a few revolutions of drive gear 42, switch disks 16, 18 and 20 reach the switching position and stop the drive. Then adjustment knob 36 is pressed in and turned until switch rollers 50 are lifted out of notches 28, so that the drive again begins running. The switch disks are not driven, however.

When the device being controlled, for example the venetian blind drive, reaches the desired shutoff position, adjustment knob 36 is turned back again so that switch rollers 50 drop into notches 28 on the switch disks, actuating microswitch 52 and shutting off the drive. Then adjustment knob 36 is pulled out again so that gear 38 is engaged with drive gear 42 and the rotary drive connection is restored. Then locking element 58 is pushed into recess 56 in order to prevent inadvertent axial displacement of central gear 30.

Adjustment of switch disks 16', 18' and 20' to the other end position of the rotary movement of the drive and/or the other shutoff position of the venetian blind drive is accomplished in similar fashion.

It will be obvious to those skilled in the art that various changes may be made without departing from the spirit of the invention, and therefore the invention is not limited to what is shown in the drawings and described in the specification but only as indicated in the appended claims.

I claim:

1. In a device for terminating the rotary movement of a driven shaft after an adjustable predetermined number of revolutions, said device comprising a first switch disk disposed coaxially adjacent a second switch disk, said first and second disks defining respectively notches on their outer circumferences, switch arm means movably mounted adjacent said disks for sensing when said notches are in a corresponding angular position, and means responsive to said sensing means for terminating the rotary movement of said driven shaft, planet carriers for rotatably mounting said first and second disks for coaxial rotation, said first and second disks defining respective annular openings in the central portion of said disks, said annular openings having different numbers of gear teeth thereon, drive means including an elongated central gear means extending coaxially through said annular openings of said first and second disks and adapted to be rotatably driven by said driven shaft;

a first planet gear means connecting said elongated central gear means to said gear teeth on said annular opening to said first disk;

a second planet gear means connecting said elongated central gear means to said gear teeth on the annular opening of said second disk; and said planet carriers comprising means for rotatably mounting said first and second planet gear means thereto, being connected non-rotatably together and each rotatably supporting a said disk on the outer circumference thereof.

2. A device as set forth in claim 1, and further including a second device as set forth in claim 1, each said central elongated gear means having a coaxially disposed gear thereon, a drive gear on said driven shaft meshing with said coaxially disposed gears, whereby to terminate the rotary motion of a driven shaft in both directions thereof after a predetermined amount of rotation.

3. The invention of claim 1, said device comprising spaced drive plates, said planet carriers being mounted in a fixed position between said drive plates, said planet carriers being provided with axially projecting pins for engaging corresponding recesses in an adjacent planet carrier and adjacent drive plate.

4. The invention of claim 3, wherein said means for mounting said first and second planet gear means comprises bearing pins axially projecting from said planet carriers, the forward ends of said pins inserted in recesses in an adjacent planet carrier and drive plate to form said non-rotational connection.

5. The invention of claim 3, and means for mounting said elongated central gear means axially displaceably, a coaxially disposed gear permanently connected to said central gear, a drive gear on said driven shaft meshing with said coaxially disposed gear when said elongated central gear means is at one end position along its axial displacement path, and is axially out of mesh with said coaxially disposed gear when said central gear means is in the other end position of said displacement path.

6. The invention of claim 5, wherein said elongated central gear means has a shaft stub extending beyond said drive plates, said shaft stub having a circumferential notch, an adjustment button disposed on said shaft stub, and a locking element, said locking element being moveable into said circumferential notch on said shaft stub to prevent axial displacement of said elongated central gear means in the end position along said displacement path corresponding to the meshing of said elongated central gear means with said drive gear.

7. The invention of claim 1, wherein said driven shaft is the electrically driven shaft of a venetian blind.

* * * * *